United States Patent [19]

Shanklin et al.

[11] Patent Number: 4,931,200

[45] Date of Patent: Jun. 5, 1990

[54] MULTIPLE SOLUTION ADD-ON METHOD FOR INCREASING THE LEVEL OF ACTIVE DETERGENT SOLIDS IN A LAUNDRY DETERGENT SHEET

[75] Inventors: Gary L. Shanklin, Appleton; Maung H. Win, Neenah, both of Wis.

[73] Assignee: Kimberly-Clark Corporation, Neenah, Wis.

[21] Appl. No.: 189,883

[22] Filed: May 3, 1988

[51] Int. Cl.[5] ..... C11D 10/02; C11D 11/00; C11D 17/02; C11D 17/06

[52] U.S. Cl. ..... 252/91; 156/62.2; 156/167; 252/90; 252/174; 427/242; 428/236; 428/245; 428/260; 428/279; 428/289

[58] Field of Search ..... 252/90, 91, 174; 428/236, 256, 260, 279, 289; 156/62.2, 167; 427/242

[56] References Cited

U.S. PATENT DOCUMENTS 4,248,928 2/1981 Spaelini ..... 428/286

*Primary Examiner*—Paul Lieberman
*Assistant Examiner*—A. Beadles-Hay
*Attorney, Agent, or Firm*—Gregory E. Corft

[57] ABSTRACT

The total active detergent solids which can be incorporated with a nonwoven web is increased by the separate addition of a solution containing the active detergent solids and a solution containing detergent enhancers, such as anti-redeposition agents, water-softening agents, and salts.

9 Claims, 1 Drawing Sheet

MULTIPLE SOLUTION ADD-ON METHOD FOR INCREASING THE LEVEL OF ACTIVE DETERGENT SOLIDS IN A LAUNDRY DETERGENT SHEET

BACKGROUND OF THE INVENTION

Laundry detergents are most commonly available in either liquid or powder form. In order to use such detergents, the user must measure out a certain quantity from a supply bottle or box and pour the measured amount into the clothes washer. In addition, if a fabric softener is desired, the fabric softener must be separately measured or at least separately deposited into the washer or dryer. Such multiple products, containers, and measuring can be messy and, at the very least an inconvenience, particularly for apartment dwellers who must carry all the necessary containers, et., to the laundry area.

In this regard, the prior art discloses a variety of alternative cleaning products which are intended to provide improved convenience to the consumer. For example, U.S. Pat. No. 4,356,099 to Davies et al. discloses a laundry cleaning product comprising a plastic bag containing a liquid detergent. The bag has a weak seal which is opened by the mechanical action of the washing machine, thereby releasing the liquid detergent.

U.S. Pat. No. 4,188,304 to Clarke et al. discloses a similar detergent product comprising a plastic bag containing a particulate detergent. The bag contains a water-sensitive seal which discharges the contents of the bag when contacted with water.

U.S. Pat. No. 3,685,075 to Morton discloses a sheet substrate containing a fabric softener which is to be preferably used in the clothes dryer, but can also be added to a wash machine during its rinse cycle.

U.S. Pat. No. 4,170,565 to Flesher et al. discloses a laundry product comprising a detergent composition contained between two layers of a water-insoluble permeable substrate such as a polypropylene meltblown web. When contacted by water during the wash cycle, the detergent is dissolved and permeates through the substrate into the wash water. Most significantly, at column 1, lines 56-65, Flesher et al. apparently recognize the potential value of a single layer substrate for delivering laundry detergent, but conclude it is not feasible because of difficulty in loading the substrate with a sufficient amount of detergent and the sticky feel of any product that might be produced.

Therefore there is a need for a laundry cleaning product containing a sufficient premature amount of detergent which is convenient to use and economical to manufacture.

SUMMARY OF THE INVENTION

In attempting to incorporate a liquid detergent formulation into a nonwoven web substrate in an amount sufficient to wash a load of laundry, it has been discovered that the presence of certain detergent enhancing ingredients inhibit the incorporation of high levels of detergent solids within a web substrate by promoting thickening and/or phase separation of the liquid detergent. Hence the amount of active detergent solids incorporated into the web, and therefore the cleaning efficacy of the product, is limited by the ability to homogeneously mix all of the detergent ingredients such that the web can be saturated with the proper proportions of all of the individual ingredients of the detergent formulation. For example, carboxymethyl cellulose, which is used as an anti-redeposition agent, causes the detergent composition to thicken, which makes homogeneous mixing more difficult. Also, sodium citrate and salts of ethylenediaminetetraacetic acid (EDTA), which are used as water softening agents, cause phase separation of the liquid detergent. However, it has now been discovered that these disadvantages can be overcome and that an increased amount of active detergent solids add-on to the web can be achieved by separately adding to the web a solution containing the active detergent solids and another solution containing the detergent enhancers. As a result the active detergent solids in the web can be increased up to about 25 weight percent.

Hence, in general the invention resides in a method for making a laundry detergent sheet comprising saturating a nonwoven web with liquid detergent and drying the web, wherein the liquid detergent is provided by two or more separate and different solutions, one of said solutions comprising active detergent solids and another of said solutions comprising detergent enhancers. For purposes herein, the term "saturating" is used to mean substantially incorporating the detergent into the web, including partial saturation or total saturation. The term "detergent enhancers" refers to detergent formulation ingredients which promote phase separation of the detergent formulations and includes anti-redeposition agents, water-softening agents, and salts.

Preferably the liquid detergent is provided to the web by two solutions in sequence, the first solution comprising active detergent solids and the second solution comprising detergent enhancers. However, the relative order in which the two solutions are added can be reversed. Because of the relative amounts of solution required, the first solution, which preferably constitutes the bulk of the detergent formulation, is preferably incorporated into the web by using a slotted bar to deposit the solution onto the web. Also, the solution can be added by dipping the web into the solution and squeezing out any excess solution. In either case the solution is absorbed into the web. The second solution, being a lower add-on amount, is preferably added to the web by spraying it onto the active detergent solids-saturated web. As used herein, a "slotted bar" applicator includes applications having slots, holes, or other orifices which serve to deposit the solution onto the surface of the web, such as by coating, injecting, printing and the like.

Depending upon the nature of the two solutions, it is also possible to premix the two solutions immediately prior to their incorporation into the web as long as the mixture remains sufficiently homogeneous for the detergent formulation ingredients to be incorporated into the web in the proper proportions. The means for mixing the two solutions can be any means which provides a short residence time, such as a small agitated tank or, preferably, an in-line static mixer having plug flow characteristics. In general the residence time in the processing system from the point of mixing to the point of incorporation into the web should be about 3 minutes or less. Preferably the residence time is less than a minute. The actual time will depend upon the stability of the particular detergent formulation.

The ingredients of the liquid detergent formulation to be incorporated into the first solution primarily include the active detergent solids, which include anionic surfactants, nonionic surfactants, cationic surfactants, and amphoteric surfactants. Other compatible ingredients, such as stabilizers, pH control agents, brighteners, enzymes, dyes, and fragrances, and/or mirror amounts of incompatible ingredients, can also be present. Water is present in an amount necessary for processing. The amounts of each ingredient in the first solution will vary widely depending upon the specific detergent formulation. However, in general the active detergent solids components (surfactants) can be present in the following weight percent, based on the total weight of the solution: nonionic (15–60); anionic (15–60); amphoteric (0–20); and cationic (0–5). Specific surfactants include: linear alkylbenzene sulfonate salts, such as sodium dodecylbenzensulfonate; alcohol ethoxysulfates, such as C12–C15 alcohol ethoxysulfate (3 moles average ethylene oxide, sodium salt); primary alcohol ethoxylates, such as 9 mole (average) ethoxylate of C12–C15 alcohol; secondary alcohol ethoxylates; alkylphenol ethoxylates; amine oxides; betaines; amidoimadazolinium quaternaries, such as amidoimadazolinium methyl sulfate; ethoxylated quaternaries, such as ethoxylated oleyl methyl sulfate; and unsaturated mono-, di-, and tri-alkyl quaternaries, such as ditallow dimethyl ammonium chloride and tallowtrimethyl ammonium chloride.

It is also within the scope of this invention to separately incorporate into the web the different forms of surfactants used in the detergent formulation, such as having a first solution containing anionic surfactant and a second solution containing nonionic surfactant. Hence the number of different solutions added to the web can be two, three, or more. In the extreme, each individual detergent formulation ingredient can be added separately.

The ingredients of the liquid formulation to be incorporated into the second solution primarily include the detergent enhancers. The amounts of each of the detergent enhancers will also vary widely depending upon the specific detergent formulation. However, in general, the detergent enhancers can be present in the following weight percent amounts, based on the total weight of the solution: sodium citrate (0–60); other water softeners (0–60); and anti-redeposition agents (0–60).

Specific detergent enhancers include sodium citrate, carboxymethyl cellulose, EDTA salts, sodium carbonate, sodium silicate, phosphates, aluminosilicates (zeolites), nitrilotriacetic acid salts, sodium borate, poly (vinyl alcohol), poly (vinyl acetate), and polyvinylpyrrolidone. Other compatible ingredients, such as stabilizers, pH control agents, brighteners, enzymes, dyes, and fragrances, and/or minor amounts of incompatible ingredients, can also be present. Preferably, fragrances are added to the web after the drying step due to their volatility.

The nonwoven web is preferably a meltblown web made from a thermoplastic polymer having a melting point greater than 110° C.

Polymers which melt at lower temperatures are more likely to melt if exposed to clothes dryer temperatures. A suitable polymer is polypropylene, which is the most commonly used polymer for making meltblown webs. However, polymers having melting points above 165° C. and preferably above 200° C. are preferred. Specific examples include poly(ethylene terephthalate), which melts at about 250° C., polycaprolactam (nylon 6), which melts at about 220° C., poly(butylene terephthalate), which melts at about 221° C., and polymethyl pentene, which melts at about 240° C.

The process for making such meltblown webs is well known in the art and is used extensively for manufacturing a wide variety of commercial nonwoven products. Representative examples of the meltblowing process are disclosed in U.S. Pat. No. 3,978,185 to Buntin et al. dated Aug. 31, 1976; U.S. Pat. 4,298,649 to Meitner dated Nov. 3, 1980; and U.S. Pat. No. 4,100,324 to Anderson et al. dated July 11, 1978, all herein incorporated by reference. For purpose of meltblowing, it is preferred that the apparent viscosity of the polymer as it leaves the die tip be about 500 poise or less, most preferably from about 150 to about 300 poise. Higher apparent viscosities provide lower throughputs which are generally unsatisfactory for commercial operation. Increased throughputs can be achieved by lowering the apparent viscosity, which can be lowered either by lowering the molecular weight of the polymer or by raising the temperature of the polymer. It will be appreciated, however, that other meltblowing processes will produce webs suitable for purpose of this invention. The meltblown web can be combined or laminated to other supporting webs, such as spunbonded webs, in order to impart strength or other attributes to the product.

The basis weight for a single sheet of the untreated meltblown base webs of this invention can range form about 80 to about 300 grams per square meter. Preferably the basis weight will be from about 110 to about 250, and most preferably about 160 grams per square meter. Basis weights lower than the abovesaid range lack sufficient pore volume to hold the amount of liquid detergent necessary to wash a load of laundry at a reasonable sheet size. Basis weights greater than the abovesaid range are too difficult to convert. It is within the scope of this invention, however, to incorporate more than one ply into the product to increase the detergent load.

The size of the meltblown web can be from about 200 to about 2000 square centimeters, preferably from about 600 to about 1,000 square centimeters, and most preferably about 800 square centimeters. The minimum size of the web is limited by the amount of liquid detergent the web can absorb and hold. The maximum size is determined by consumer acceptance, convenience and packaging considerations. It is preferred that the meltblown web be pattern bonded to maintain integrity during use. Pattern bonding is commonly performed during manufacture of the meltblown web by hot embossing or ultrasonic bonding of the newly formed web. The product of this invention can be dispensed in sheet form or from perforated rolls. In addition, the single sheets can be perforated to be torn in half for half loads of laundry.

The amount of active liquid detergent solids provided by the liquid detergent must be at least 1 gram of meltblown web, preferably from about 2 to about 5 grams per gram and most preferably from about 3 to about 4 grams per gram. The amount of active detergent solids retained by the meltblown web has been measured to be as high as about 12 grams per gram and will depend upon the detergent formulation, the extent which it is condensed, the basis weight and area of the web, and the pattern bonding area of the web. The capacity of the web to hold detergent will decrease as the pattern bonding area is increased. Hence it is necessary to strike a balance between detergent capacity and web integrity during use. Generally, the pattern bonding area can range from about 5 to about 40 percent of the total surface area of the web, with from about 10 to about 20 percent being preferred, and about 15 percent being most preferred.

It is preferred that the meltblown web also contain a fabric softener which softens the laundry during the drying cycle. Webs impregnated with such softening agents are well known in the art and are well known commercial products. Suitable fabric softening agents include those described in U.S. Pat. No. 3,686,025 to Morton, dated Aug. 22, 1972.

DETAILED DESCRIPTION OF THE DRAWING

Figure 1:
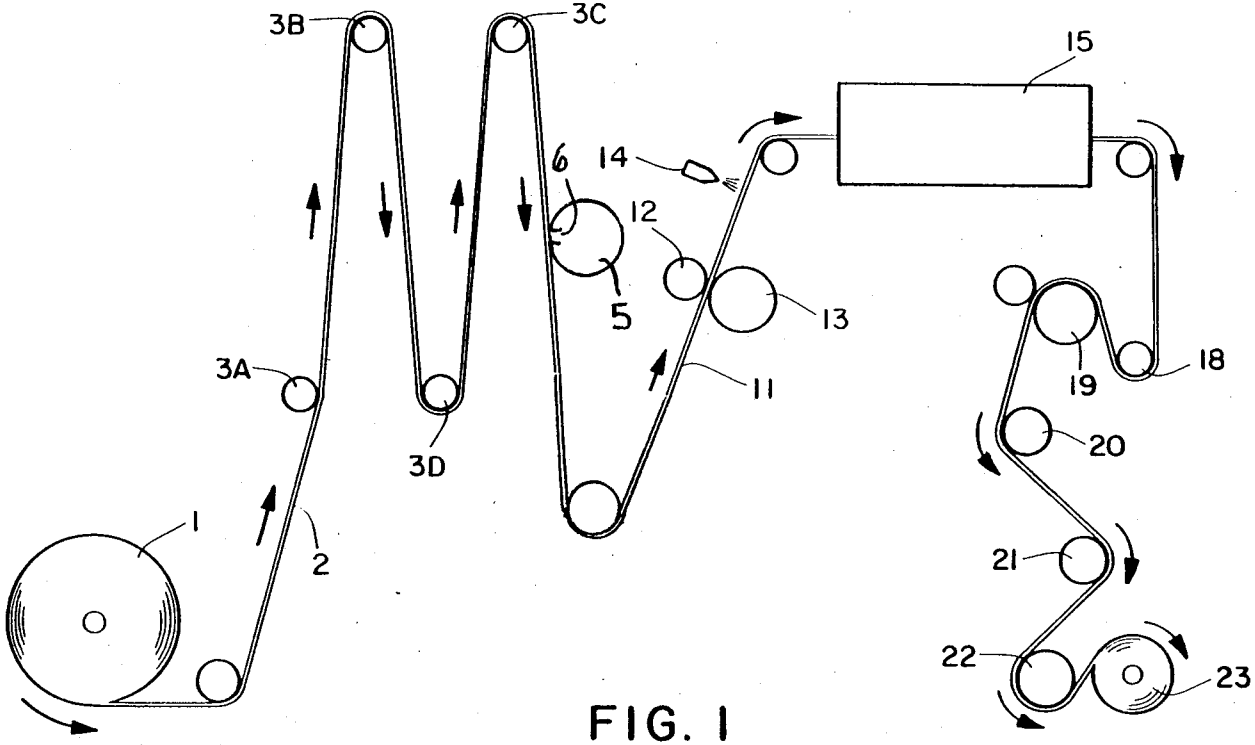
FIG. 1 is a schematic view of a continuous process for making the product of this invention.

Directing attention to FIG. 1, method of carrying out the invention is illustrated. Shown is a supply roll 1 of the meltblown web material to be saturated with liquid detergent ingredients. Preferably the web has been thermally pattern-bonded to provide sufficient integrity to withstand a wash and dry cycle without disintegrating. The web 2 is passed through a series of tension control rolls 3A, 3B, 3C, and 3D and passed over a slotted bar applicator 5 which is filled with the first aqueous solution containing the active detergent solids. The solution is deposited onto the web through the slot 6 to saturate the web with the solution. The rate at which the solution is applied will depend upon the line speed, the detergent composition, the absorbancy of the web, etc. As previously mentioned, other means for incorporating the solution into the web are also suitable. The first solution can be applied to either or both sides of the web.

After leaving the slotted bar applicator, the saturated web 11 passes through a controlled nip between nip rolls 12 and 13 which serves to enhance the even distribution of the liquid throughout the web.

The second solution, containing the detergent enhancers, is preferably applied to the web with spray device 14 as shown. The second solution can be applied to either or both sides of the web if so desired to increase uniformity and/or quantity.

The treated web then passes through a dryer 15, preferably an air flotation dryer, which removes substantially all (up to about 95 percent) of the available moisture, which includes alcohol and water. More typically the moisture removal will be on the other of about 80 percent. The product leaving the dryer contains concentrated liquid detergent having a gel-like consistency, yet the web has an acceptable feel.

After drying, the dried web passes around a tension control roll 18, a pull roll 19, a slitter roll 20, a Mount Hope roll 21, and a rewind drive roll 22. The web is thereby wound onto the rewind roll 23 for subsequent converting and packaging operations.

It will be appreciated that the foregoing description, given for purposes of illustration, is not to be construed as limiting the scope of this invention.

We claim:

1. A method for making a laundry detergent sheet comprising saturating a nonwoven web with liquid detergent and drying the web, wherein the liquid detergent is provided by two or more separate and different solutions, one of said solutions comprising active detergent solids and another of said solutions comprising detergent enhancers, said active detergent solids being selected from the group consisting of anionic, nonionic, cationic, and amphoteric surfactants.

2. The method of claim 1 wherein the two or more solutions are mixed together immediately prior to saturating the web, such that the mixture remains sufficiently homogeneous to incorporate the mixture into the web.

3. The method of claim 1 wherein the two or more solutions are incorporated into the web in sequence.

4. The method of claim 1 wherein the active detergent solids are provided in at least two different solutions.

5. The method of claim 4 wherein one solution comprises predominantly anionic active detergent solids and another solution comprises predominantly nonionic active detergent solids.

6. The method of claim 1 wherein the liquid detergent is provided by two separate solutions, a first solution comprising active detergent solids and a second solution comprising detergent enhancers.

7. The method of claim 6 wherein the web is saturated with the first solution using a slotted bar and the web is subsequently sprayed with the second solution.

8. The method of claim 6 wherein the second solution comprises at least one detergent enhancer selected from the group consisting of sodium citrate, carboxymethyl cellulose, and salts of ethylenediaminetetraacetic acid.

9. The method of claim 6 wherein the first solution comprises at least one surfactant selected from the group consisting of nonionic surfactants and anionic surfactants.

* * * * *